US010806195B2

(12) United States Patent
Kalliontzis

(10) Patent No.: US 10,806,195 B2
(45) Date of Patent: Oct. 20, 2020

(54) MITT SYSTEM

(71) Applicant: Daniel Patrick Stavros Kalliontzis, Jacksonville Beach, FL (US)

(72) Inventor: Daniel Patrick Stavros Kalliontzis, Jacksonville Beach, FL (US)

( * ) Notice: Subject to any disclaimer, the term of this patent is extended or adjusted under 35 U.S.C. 154(b) by 0 days.

(21) Appl. No.: 15/929,068

(22) Filed: Nov. 29, 2018

(65) Prior Publication Data

US 2020/0170319 A1 Jun. 4, 2020

(51) Int. Cl.

| | |
|---|---|
| ***A41D 19/00*** | (2006.01) |
| ***A41D 19/01*** | (2006.01) |
| ***A45F 5/02*** | (2006.01) |
| *A41D 19/015* | (2006.01) |

(52) U.S. Cl.

CPC ..... *A41D 19/0041* (2013.01); *A41D 19/01* (2013.01); *A45F 5/021* (2013.01); *A41D 19/01529* (2013.01)

(58) Field of Classification Search

CPC ..... A41D 19/0041; A41D 19/01; A41D 19/01529; A45F 5/021

See application file for complete search history.

(56) References Cited

U.S. PATENT DOCUMENTS 2,103,711 A * 12/1937 Cole ..... A41D 19/0027 2/160
2,299,855 A * 10/1942 Smith ..... H02G 1/02 2/168
2,986,396 A * 5/1961 Abbott ..... A63B 67/00 473/502
3,251,109 A * 5/1966 Wilson ..... A63B 67/00 24/578.15
4,069,913 A * 1/1978 Harrigan ..... A61B 42/50 128/856
4,155,494 A * 5/1979 Poncy ..... A61B 42/40 206/278
4,228,935 A * 10/1980 Madray ..... A47G 25/904 2/161.6
4,447,912 A * 5/1984 Morrow ..... A61F 13/104 2/159
4,805,242 A * 2/1989 Bolton ..... A41D 19/002 2/160
4,863,084 A * 9/1989 Nabozny ..... A41D 19/0068 224/673
4,905,321 A * 3/1990 Walunga ..... A41D 19/01582 2/160
4,942,992 A * 7/1990 Fischer ..... A61B 42/40 224/240
5,003,637 A * 4/1991 Lonon ..... A41D 19/0024 2/160

(Continued)

*Primary Examiner* — Richale L Quinn

(74) *Attorney, Agent, or Firm* — Kintner IP, LLC; Mary Frances Ludwig

(57) ABSTRACT

A mitt system includes a mitt for protecting a user's hand during performance of dirty tasks, and a carrier attachable to the user's body and designed hold the mitt spaced apart from the user's body. The mitt is configured for insertion of the hand through an opening and reception of the hand by a thumb section and a finger section without manipulation of an external surface. The carrier includes a first coupler which retains the mitt and a clip for attachment to the body. In an embodiment, a rigid member maintains the opening of the mitt accessible for reception of the hand.

14 Claims, 9 Drawing Sheets

(56) References Cited

U.S. PATENT DOCUMENTS 5,226,190 A * 7/1993 Lynch ..... A63B 71/148 2/160
5,353,538 A * 10/1994 Hakedal ..... F41C 23/02 42/85
5,435,273 A * 7/1995 Landis ..... A01K 27/005 119/795
5,542,125 A * 8/1996 Zuckerwar ..... A41D 19/0051 2/158
5,853,210 A * 12/1998 Robinson ..... A41D 19/0024 294/25
6,073,823 A * 6/2000 Gordon ..... A45F 5/02 224/661
6,079,049 A * 6/2000 Moir ..... A41D 19/0027 2/108
6,116,668 A * 9/2000 Carpol ..... A41D 19/0075 2/160
6,393,615 B1 * 5/2002 Bedell ..... A41D 19/01547 2/159
6,485,467 B1 * 11/2002 Crook ..... A61B 17/3423 604/174
6,511,111 B2 * 1/2003 Dooley ..... A01K 23/005 2/159
7,146,651 B1 12/2006 Lapin
7,451,496 B2 * 11/2008 Carey ..... A41D 19/01529 2/160
7,527,181 B1 * 5/2009 Sullivan ..... A47G 25/904 223/111
7,644,448 B2 * 1/2010 Grilliot ..... A41D 19/0013 2/161.6
7,735,682 B1 * 6/2010 Cassel ..... A47K 10/38 221/155
8,113,481 B1 * 2/2012 Krysak ..... A45F 5/021 24/343
8,413,265 B1 * 4/2013 Hoppes ..... A41D 19/0024 2/160
8,413,842 B1 * 4/2013 Clou ..... B65H 35/10 2/159
8,746,517 B2 * 6/2014 Esten ..... A47G 25/904 2/160
8,960,493 B1 * 2/2015 Dennison ..... A47G 25/904 221/45
9,061,173 B1 * 6/2015 Felkel ..... A63B 21/0557
9,234,699 B2 * 1/2016 Hall ..... F26B 21/003
9,648,941 B1 * 5/2017 Gonzalez ..... A45F 5/00
10,165,814 B2 * 1/2019 Thompson ..... A41F 1/002
10,258,855 B1 * 4/2019 DiMartino ..... A63B 71/06
10,285,462 B2 * 5/2019 Charles ..... A63B 71/141
2002/0189007 A1 * 12/2002 Cormier ..... A41D 19/0089 2/457
2005/0052037 A1 * 3/2005 Spuck ..... E01H 1/1206 294/1.3
2005/0261113 A1 * 11/2005 Wilkinson ..... A63B 21/0004 482/124
2005/0263087 A1 * 12/2005 Livingston, III ..... E01H 1/1206 119/161
2006/0027187 A1 * 2/2006 Nicastro ..... A01K 27/006 119/770
2006/0086629 A1 * 4/2006 Cacioppo, Jr. ..... A41D 19/0041 206/289
2006/0289574 A1 * 12/2006 Cacioppo, Jr. ..... A41D 19/0041 224/162
2007/0094766 A1 * 5/2007 Liu ..... A41D 19/0072 2/159
2008/0156280 A1 * 7/2008 McNeill ..... A01K 27/00 119/795
2009/0039129 A1 * 2/2009 Peterson-Malesci ..... A45F 5/02 224/682
2009/0095225 A1 * 4/2009 O'Connell ..... A01K 27/006 119/161
2009/0315350 A1 * 12/2009 Allen ..... E01H 1/1206 294/1.3
2010/0031415 A1 * 2/2010 Shadid ..... A41D 13/0012 2/87
2010/0107303 A1 * 5/2010 Esten ..... A41D 19/0034 2/160
2010/0192277 A1 * 8/2010 Powell ..... A41D 1/002 2/160
2011/0131702 A1 * 6/2011 Rodgers ..... A41D 19/002 2/158
2011/0132952 A1 * 6/2011 Peterson-Malesci ..... A45F 5/02 224/660
2012/0310130 A1 * 12/2012 Crompton ..... A61F 5/0118 602/21
2013/0036528 A1 * 2/2013 Wilson ..... A41D 19/0034 2/160
2014/0061261 A1 * 3/2014 Yakeley ..... A63B 57/00 224/183
2015/0075448 A1 * 3/2015 Clark ..... A01K 27/00 119/797
2018/0255848 A1 * 9/2018 Moreau ..... A41D 19/01

* cited by examiner

MITT SYSTEM

BACKGROUND OF THE INVENTION

A user performing a dirty task may desire hand protection. When such a task is performed intermittently, it may be desirable to readily remove and put on the hand protection while minimizing contact with dirty surfaces of the hand protection. For example, a person playing catch with their dog will need to handle a ball which has been in the dog's mouth. While playing catch, the person may wish to also intermittently handle clean objects, such as a touchscreen device. It is inconvenient for the user to continually wipe their hands clean in between handling the dirty and clean objects.

There is therefore a need for hand protection which is easily removable and kept accessible for frequently taking on and off. It is also desirable that the dirty hand protection can be stored without contacting the user's body or clothing.

BRIEF SUMMARY OF THE EMBODIMENTS

Embodiments disclosed herein are directed to a mitt system which protects a user's hand when performing dirty tasks, such as, for example, handling a toy which has been in an animal's mouth, or barbequing. The system includes a body-wearable carrier which enables the user to quickly put on or remove the mitt while having minimal contact with the exterior surface of the mitt.

According to one or more embodiments, a mitt system includes a mitt having an opening, a thumb section, a finger section, and an external surface having a palm side and a back side. The mitt is configured for insertion of a hand through the opening and reception of the hand by the thumb section and finger section without manipulation of the external surface. A carrier wearable on a user's body has a first coupler configured to receive the mitt. The carrier is configured to hold the mitt spaced apart from the user's body with the opening of the mitt accessible for reception of the hand.

According to one or more embodiments, the mitt has a second coupler configured to couple with the first coupler of the carrier. In some embodiments, the first coupler and the second coupler are magnetically connectable.

According to one or more embodiments, the mitt includes a rigid member surrounding the opening and configured for passage of the hand therethrough. In some embodiments, the rigid member is removable from the mitt.

According to one or more embodiments, the carrier has a proximal face including a clip, and a distal face from which the first coupler is accessible.

According to one or more embodiments, the carrier has an upper end configured for attachment to the user's body and a lower end, and the distal face is contoured forwardly from the upper end to the lower end.

According to one or more embodiments, the mitt includes a strap located on the palm side of the external surface and configured to retain a cooperating item, which the user desires not to touch, in contact with the external surface.

According to one or more embodiments, the carrier includes a dispenser for sanitary products.

According to one or more embodiments, the back side of the external surface has a pocket configured to be opened without manipulation of the palm side of the external surface.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the mitt system are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

Figure 1:
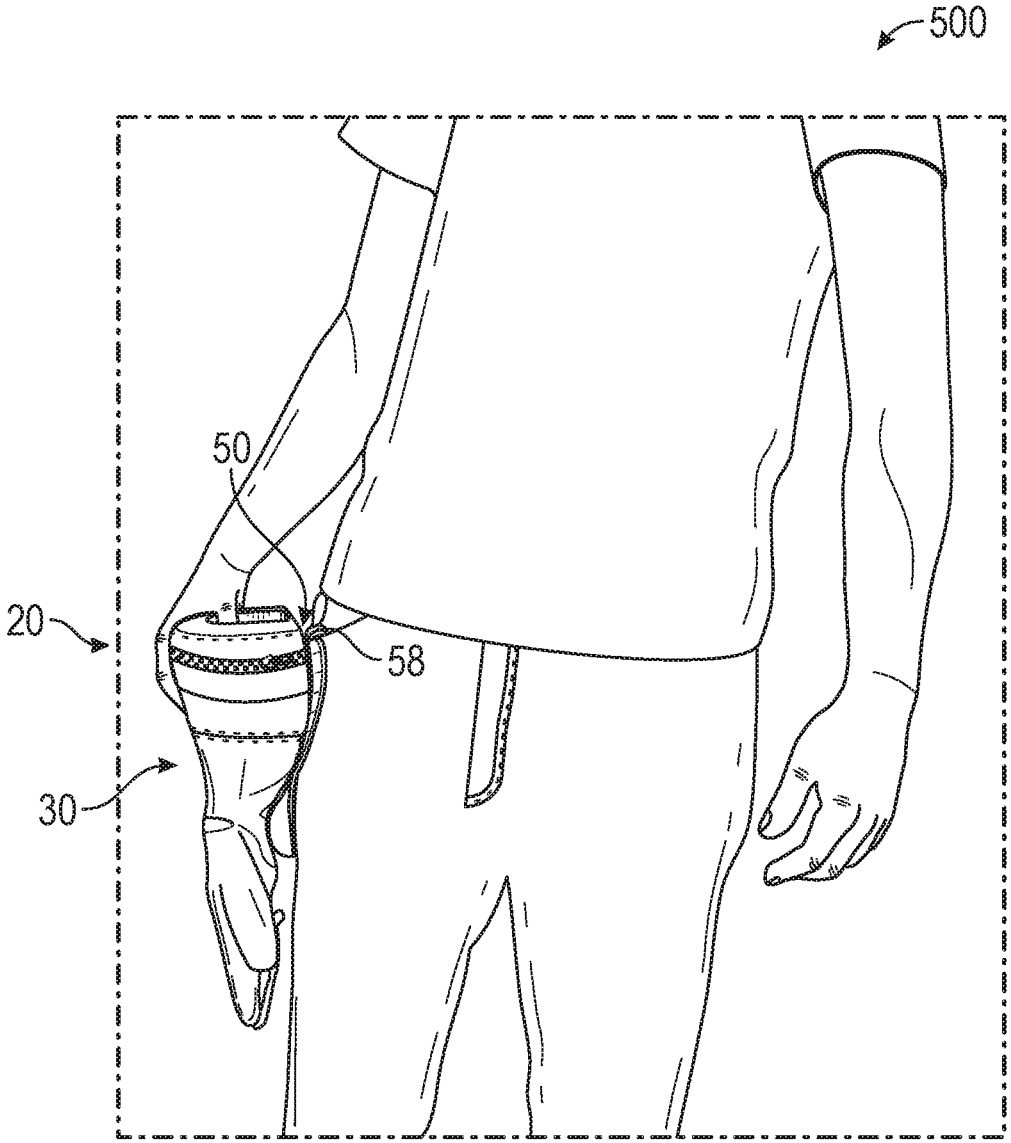
FIG. 1 is a reduced perspective view of an embodiment of a mitt system in a position of use.

Referring initially to FIG. 1, there is illustrated a mitt system generally designated as 20, which includes a mitt 30 and a carrier 50 configured to be worn on the body of a user 500. Mitt 30 is designed to cover the user's hand and wrist particularly when performing a dirty task, such as handling a toy which has been in an animal's mouth. Carrier 50 is designed to hold the mitt in a position spaced apart from the user's body so that dirt will not be transferred from the mitt to the user's body or clothing.

Figure 3:
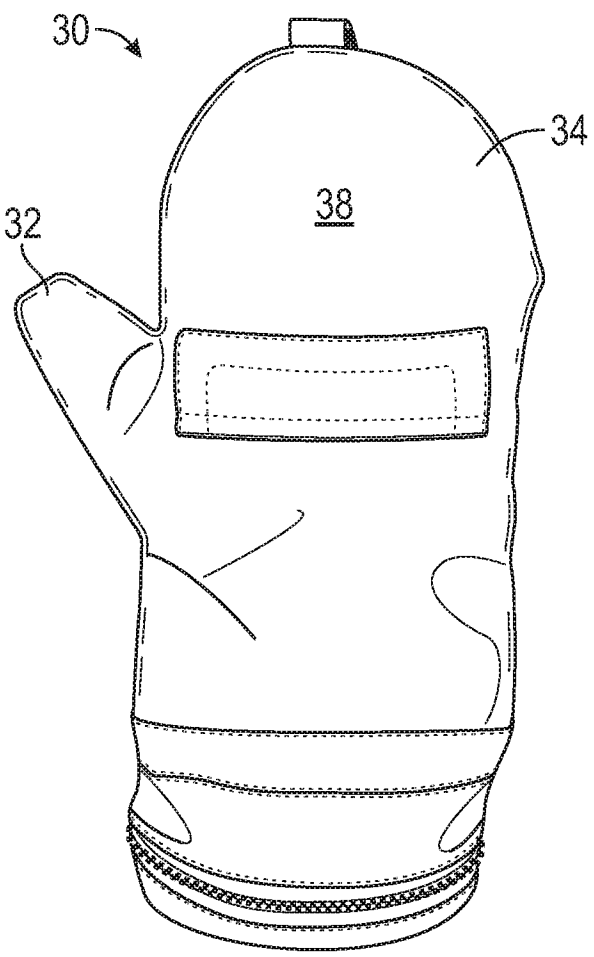
FIG. 3 is a view of a back side of the mitt.
Figure 2:
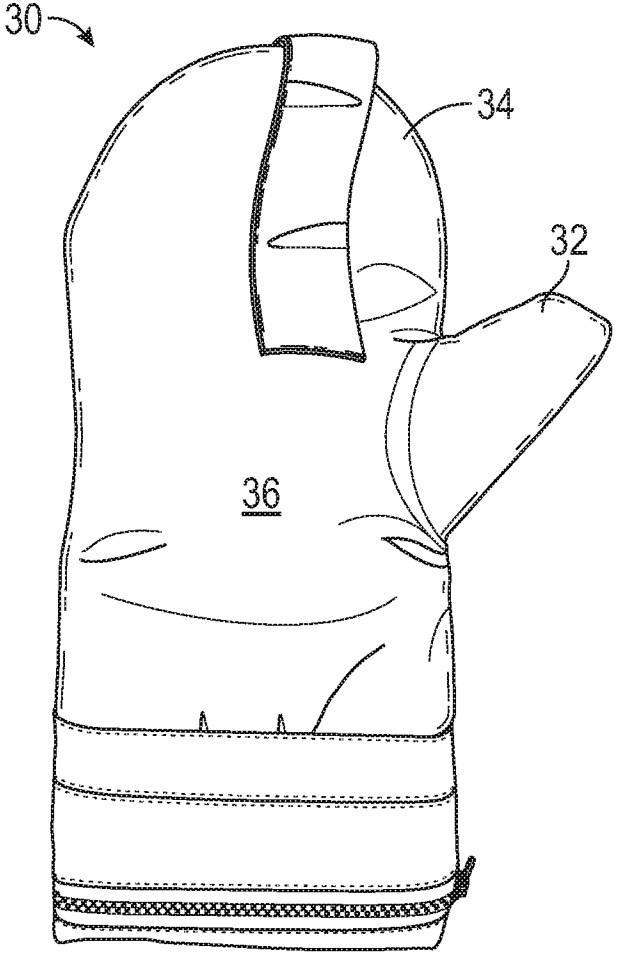
FIG. 2 is a view of a palm side of an embodiment of a mitt.
Figure 4:
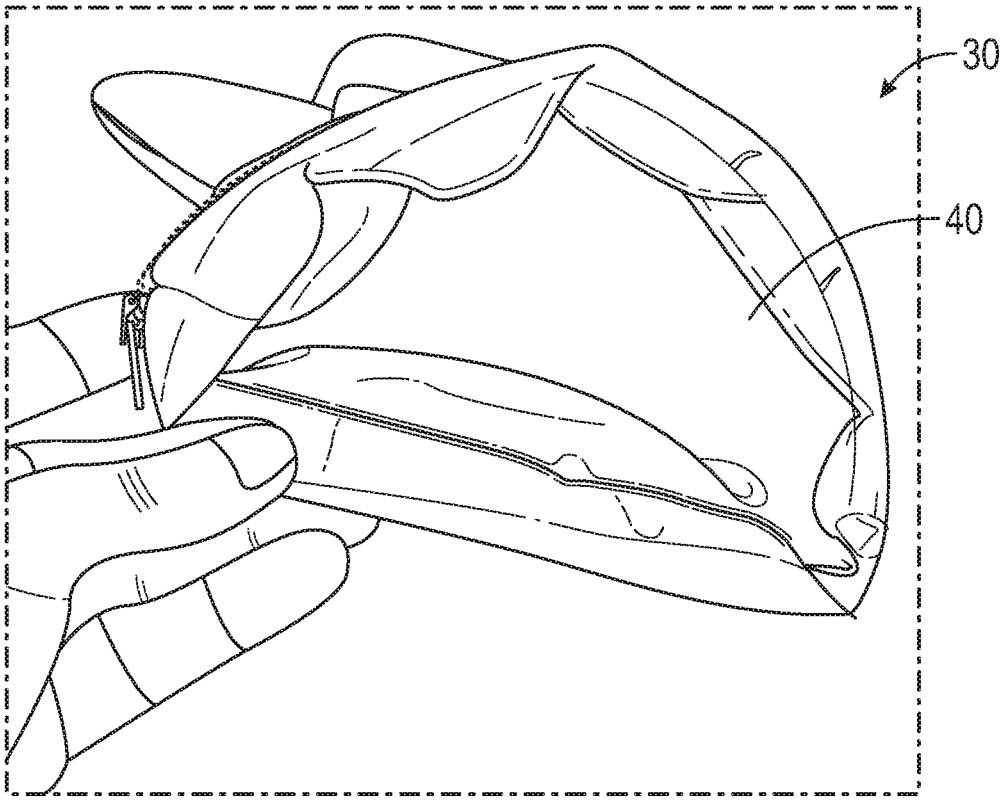
FIG. 4 is an end view of the mitt.
Figure 5:
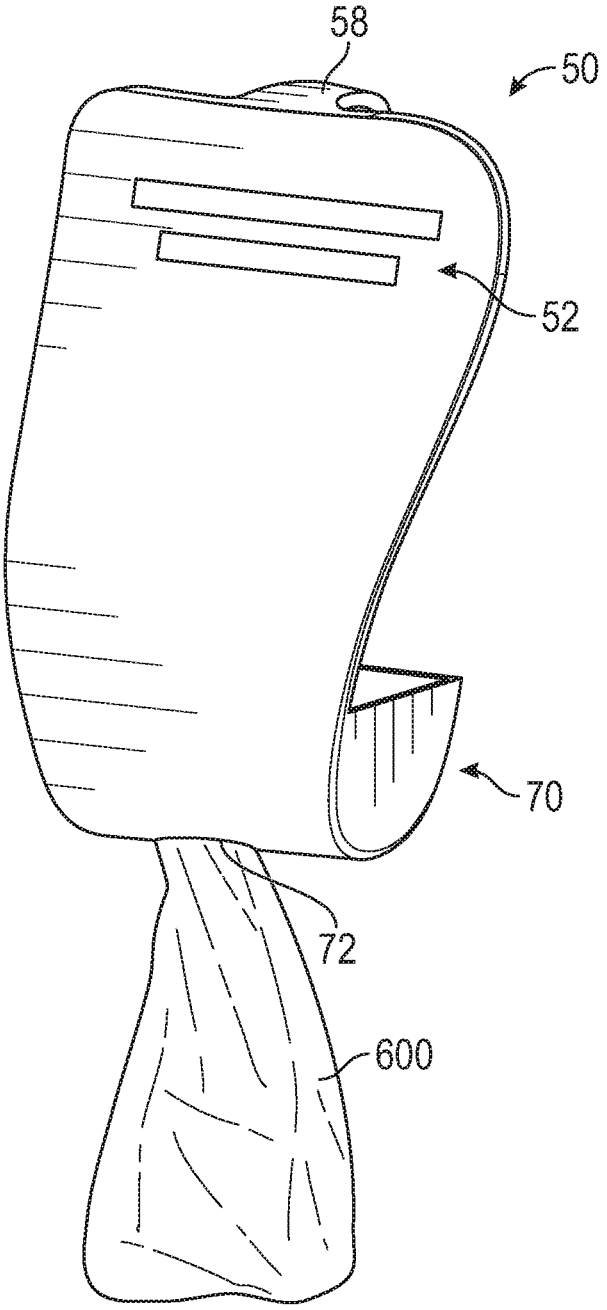
FIG. 5 is a perspective view of an embodiment of a carrier.
Figure 6:
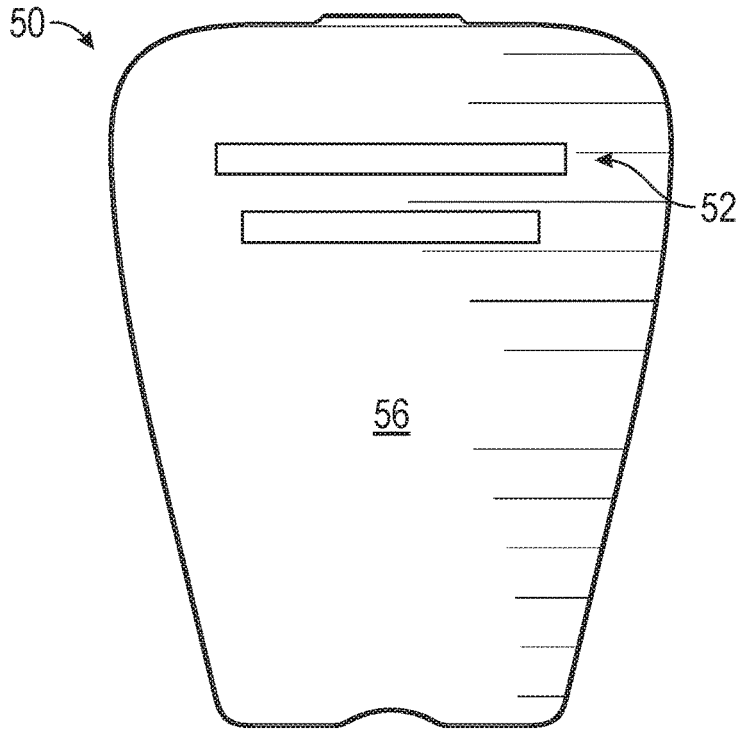
FIG. 6 is a front view of the carrier.
Figure 7:
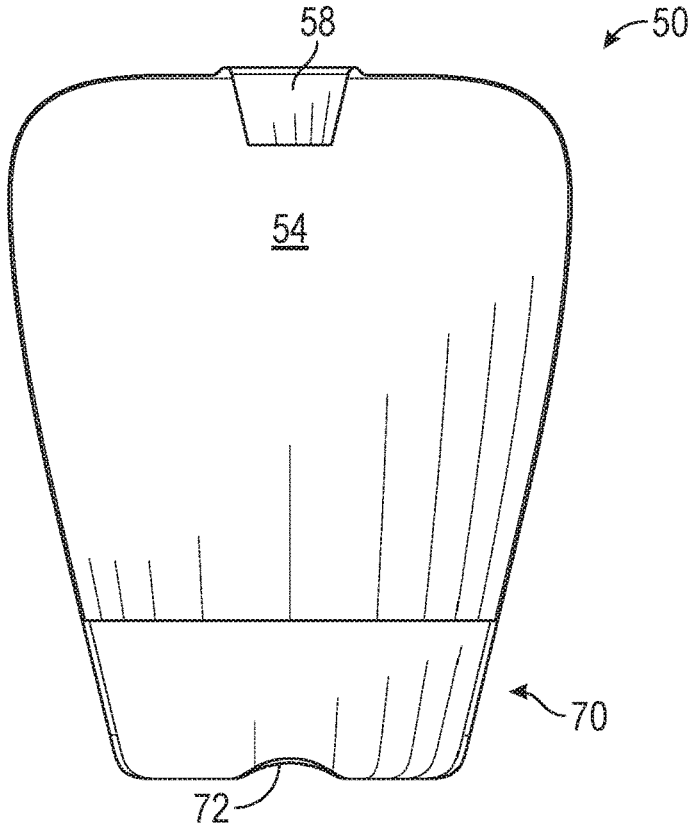
FIG. 7 is a rear view of the carrier.
Figure 9:
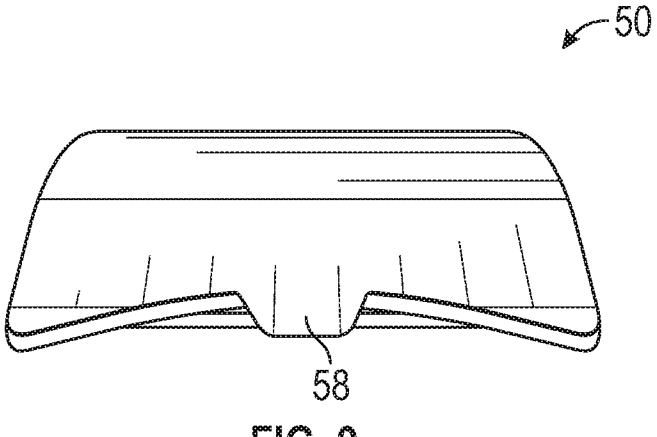
FIG. 9 is a top view of the carrier.
Figure 10:
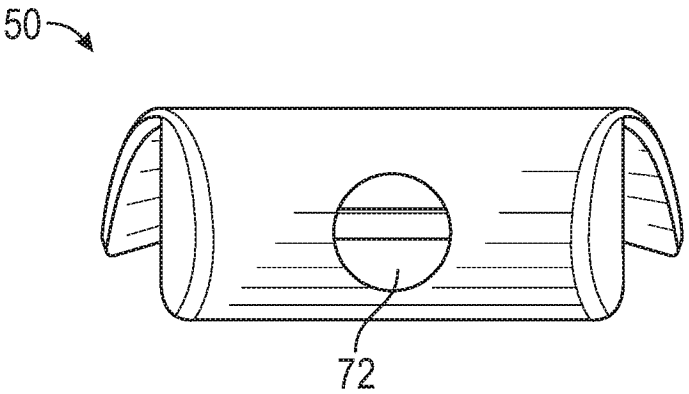
FIG. 10 is a bottom view of the carrier.
Figure 8:
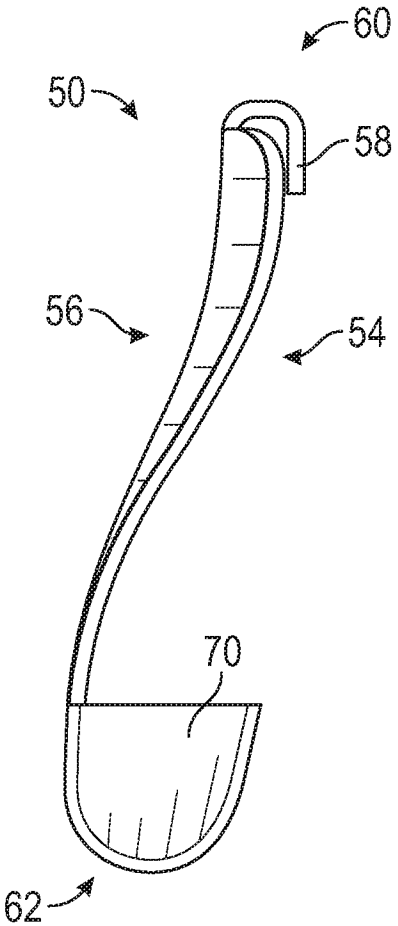
FIG. 8 is a side view of the carrier, the opposing side view being substantially a mirror image.

FIGS. 2-4 are views of a palm side 36, a back side 38, and an end, respectively, of an embodiment of mitt 30. Palm side 36 and back side 38 are two opposing sides of a continuous external surface of the mitt. An opening 40 in the end permits passage of the user's hand into a thumb section 32 and a finger section 34. 'Mitt' as used herein refers to any loosely fitted hand covering which permits a user to grip objects while the mitt is worn. An embodiment of the mitt may be a glove fitted loosely enough to allow the user to take the glove on and off without needing to manipulate the external surface, to avoid transferring dirt.

FIGS. 5-10 are perspective, front, rear, side, top, and bottom views, respectively, of an embodiment of carrier 50. Carrier 50 is configured to be worn by the user, such as by attachment of a clip 58 to a waistband, belt, or pocket edge (see also FIG. 1). In the shown embodiment, clip 58 projects rearwardly from a proximal face 54 of the carrier, the proximal face being the face nearest the body of the user when the carrier is worn.

Carrier 50 includes a first coupler 52 on a distal face 56, the distal face opposing the proximal face and being forwardly oriented, away from the body of the user. First coupler 52 is configured to retain mitt 30. In the shown embodiment, first coupler 52 is a magnet which couples to a second coupler 42 of the mitt (see FIG. 11). Second coupler 42 may also be a magnet having a second polarity opposite the first polarity of first coupler 52. Alternatively, one of the first or second couplers may be a ferromagnetic material. For example, second coupler 42 may be a magnet while first coupler 52 may be a ferromagnetic material. This configuration permits mitt 30 to be held by coupler 42 on other metal surfaces, such as a barbeque grill, a refrigerator, or a metal door. Other embodiments of first coupler 52 and second coupler 42 may be complementary snap-fitting components, hook and loop fasteners, or another type of coupler which can be operated with minimal hand manipulation.

Figure 11:
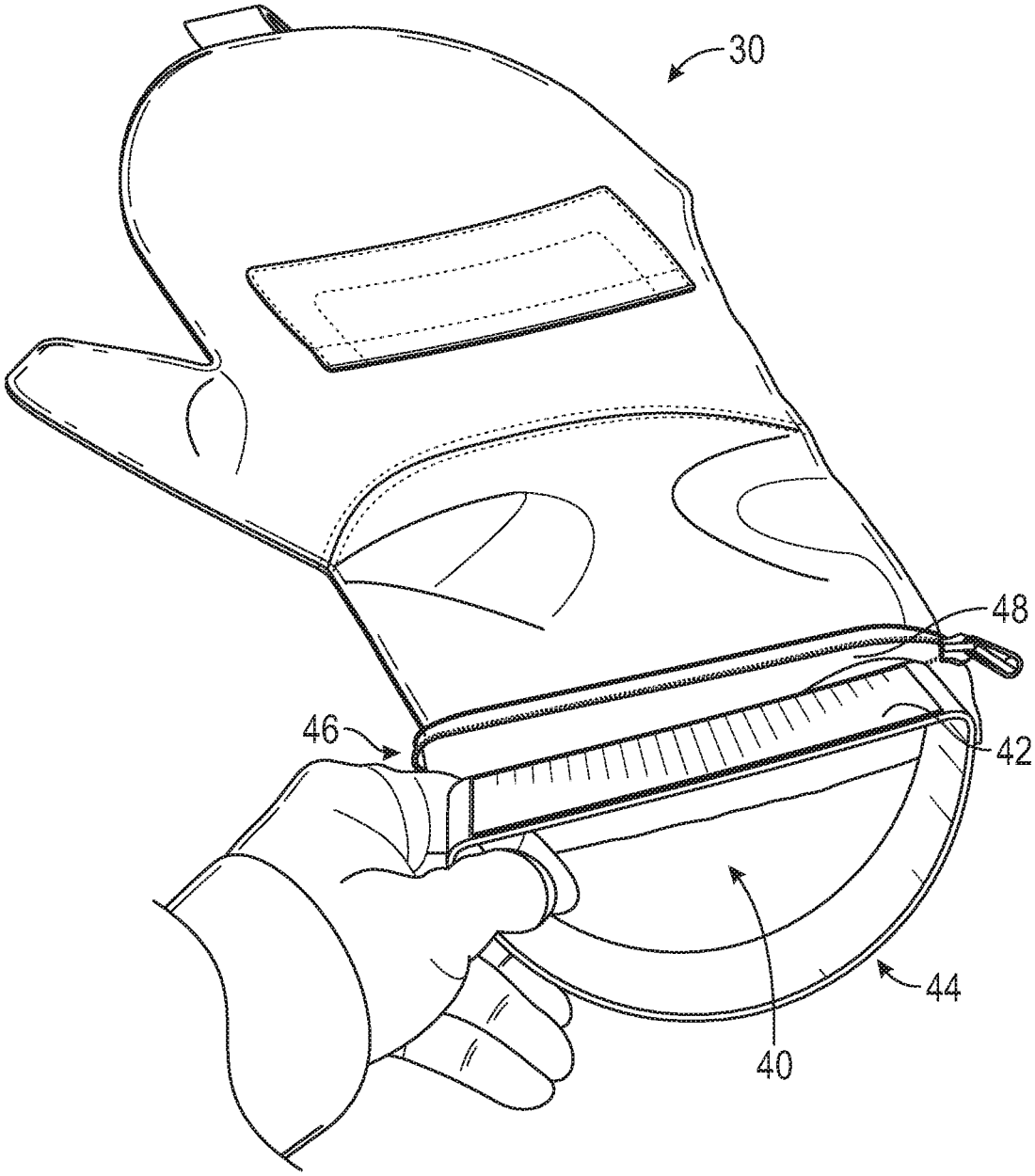
FIG. 11 is an exploded perspective view of the mitt showing a removable rigid member.
Figure 14:
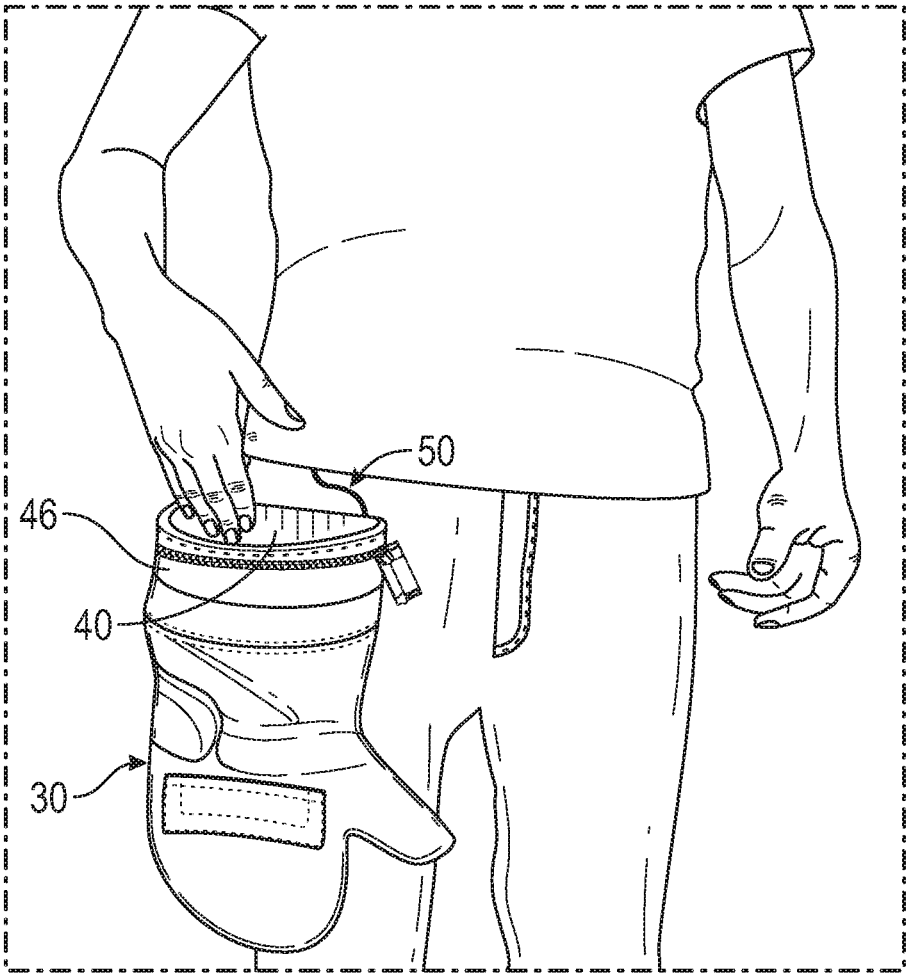
FIG. 14 is an illustration of the mitt system in another position of use.

FIG. 11 is an exploded perspective view of an embodiment of mitt 30 showing a removable rigid member 44. Rigid member 44 is a D-shaped ring in the shown embodiment, and is inserted into a pouch 46 at the end of mitt 30. Rigid member 44 at least partially surrounds opening 40, and keeps the opening dilated and accessible to receive the hand as shown in FIG. 14. This configuration allows a user to insert their hand through opening 40 without needing to contact the external surface of the mitt. The rigid member may be removable from and reinsertable into pouch 46, facilitating, for example, a user's desire to machine wash the mitt. Pouch 46 may have a resealable aperture 48 which permits access to the pouch, such as the zipper closure of the shown embodiment. Aperture 48 may alternatively be resealable with snaps, hook and loop fasteners, or other type of fastener which may be repeatedly sealed and opened in a non-destructive manner.

An embodiment of second coupler 42, shown in FIG. 11, may be a strip of magnetic or ferromagnetic material connected to rigid member 44. While FIG. 11 shows second coupler 42 as a single component, it may comprise several smaller components, for example, a row of two or more magnets. In an embodiment, second coupler 42 may be an integral feature of or may be integrally formed with rigid member 44.

Referring again to FIGS. 5-10, carrier 50 is configured to hold mitt 30 spaced apart from the user's body (see also FIG. 1). In the shown embodiment, the carrier has an upper end 60 and a lower end 62, and distal face 56 is contoured forwardly from the upper end 60 to the lower end 62. The upper end is configured for attachment to the user's body (for example, clip 58 is located at the upper end) and when mitt 30 is coupled to first coupler 52, the contour of distal face 56 serves to position the mitt in spaced apart relation to the user's body, so as to avoid transfer of dirt from the mitt to the user's body or clothing. In another embodiment, the mitt may be carried offset from the body by the carrier having a significant thickness between proximal face 54 and distal face 56. In another embodiment, first coupler 52 may be offset forwardly from the distal face, thereby increasing the distance between the mitt and the body.

In some embodiments, carrier 50 includes a dispenser 70 for dispensing a sanitary product 600, such as pet waste containment bags, sanitary hand wipes, or similar. Dispenser 70 is shown positioned at lower end 62 of the carrier, and has an aperture 72 through which products may be dispensed. In the shown embodiment, dispenser 70 has an open top which permits easy access for filling the dispenser with bags 600. In another embodiment, the top of dispenser 70 may include a lid to protect the sanitary products from contaminants which might otherwise enter the dispenser.

Figure 12:
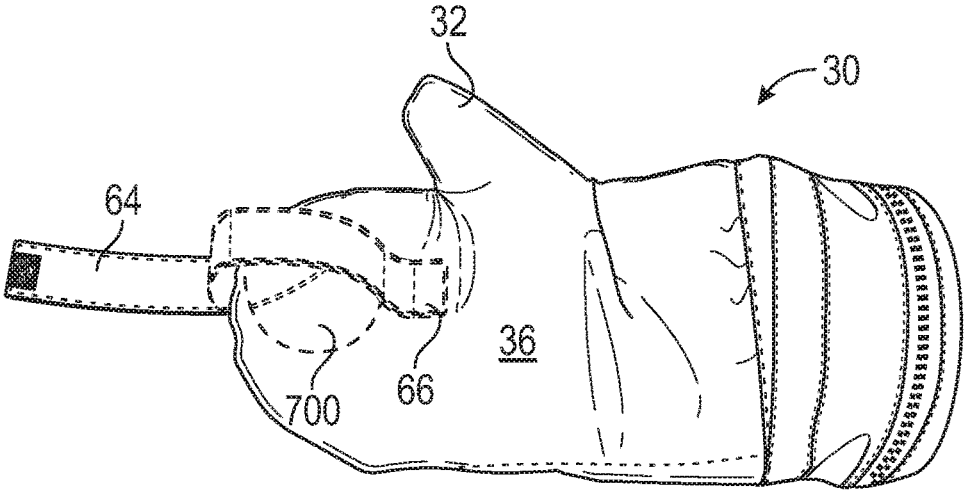
FIG. 12 is a perspective view of the palm side of the mitt showing a strap.

FIG. 12 is a perspective view of palm side 36 of mitt 30 showing a strap 64 in alternate positions of use (indicated with dashed lines). The mitt system may be used in cooperation with an item which a user desires not to touch, such as a dog toy 700. Strap 64 may be used to retain dog toy 700 in contact with the external surface of mitt 30. To use the strap, a user wearing the mitt may pick up dog toy 700, unfasten strap 64 from fastener 66 with their free hand, and fasten strap 64 to fastener 66 around dog toy 700 thereby retaining the toy. The mitt may then be attached to the carrier for easy transport of both the dirty toy and mitt. In embodiments, fastener 66 may be a hook and loop fastener, a snap, a button, or similar. In another embodiment, strap 64 may be an elastic member used without a fastener 66. In the shown embodiment, strap 64 extends from the fingertip end of the mitt to a fastener region 66 located in a position accessible by the thumb portion 32, this location of the strap and fastener allows the user to grasp the dirty object with the mitted hand while fastening the strap with their other hand.

Figure 13:
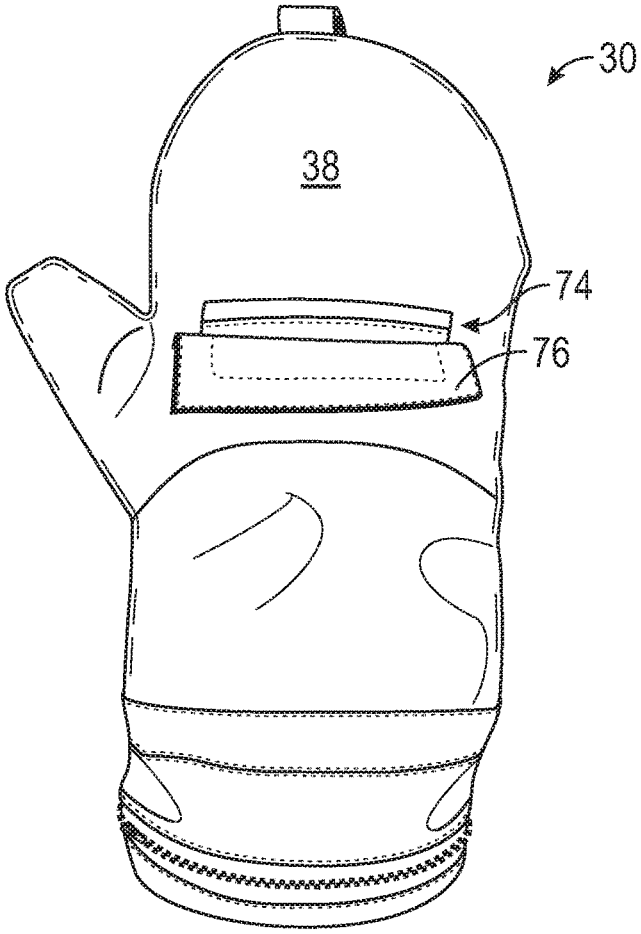
FIG. 13 is a view of the back side of the mitt showing a pocket.

FIG. 13 is a view of the back side of mitt 30 showing a pocket 74, suitable for holding small items such as a dog treat, a lighter or matches for use in barbequing, or similarly sized items. Pocket 74 is located in back side 38 of the mitt, an area which in many applications will remain cleaner than the palm side of the mitt. Pocket 74 is configured to be opened with the user's free hand, without needing to manipulate the palm side of the mitt external surface. In some embodiments, the mitt may have a flap 76 configured to cover the opening of pocket 74 and prevent dirt from entering the pocket.

FIG. 14 is an illustration of the mitt system in another position of use. In the shown embodiment, a rigid member internal to pouch 46 is maintaining opening 40 positioned for easy insertion of the user's hand. In this configuration the user does not need to contact the dirty external surface of the mitt to insert their hand into the mitt. Similarly, the mitt may be coupled to carrier 50 while worn, and the hand then removed from the mitt.

In embodiments, mitt 30 comprises machine washable fabric components. In embodiments, mitt 30 comprises natural materials, such as wool or leather. In an embodiment, materials of mitt 30 are configured to thermally insulate the user's hand, and may comprise heat resistant fabrics. In embodiments, carrier 50 comprises plastic materials and has an easily cleanable surface. In another embodiment, carrier 50 comprises metal materials.

Further provided is a mitt, configured to cooperate with a body wearable carrier.

The embodiments of the mitt system described herein are exemplary and numerous modifications, combinations, variations, and rearrangements can be readily envisioned to achieve an equivalent result, all of which are intended to be embraced within the scope of the appended claims. Further, nothing in the above-provided discussions of the mitt system and methods of use should be construed as limiting the invention to a particular embodiment or combination of embodiments. The scope of the invention is defined by the appended claims.

I claim:

1. A mitt system, comprising:

a mitt having an opening, a thumb section, a finger section, and an external surface having a palm side and a back side, the mitt configured for insertion of a hand through the opening and reception of the hand by the thumb section and the finger section without manipulation of the external surface;

a carrier having a proximal face including a clip projecting rearwardly therefrom, a distal face having an upper end configured for attachment to a user's body, a lower end, a first coupler mounted between the upper end and the lower end, and a forwardly contoured region proximate the lower end, the forwardly contoured region projecting in front of the first coupler;

the mitt having a second coupler configured to couple with the first coupler of the carrier such that when the second coupler is coupled with the first coupler the forwardly contoured region contacts the mitt below the second coupler and positions the mitt in spaced apart relation to the user's body with the opening of the mitt accessible for reception of the hand;

wherein the mitt includes a rigid member surrounding the opening and configured for passage of the hand therethrough; and wherein the mitt includes a resealable pouch surrounding the opening and the rigid member is removably located in the resealable pouch.

2. The mitt system according to claim 1, cooperating with an item which a user desires not to touch, the mitt system further including:

a strap located on the palm side of the external surface and configured to retain the item in contact with the external surface.

3. A mitt system, comprising:

a mitt having an opening, a thumb section, a finger section, and an external surface having a palm side and a back side, the mitt configured for insertion of a hand through the opening and reception of the hand by the thumb section and the finger section without manipulation of the external surface;

a carrier wearable on a user's body, the carrier having a body-facing proximal face and an opposing forwardly-facing distal face, a first coupler accessible from the distal face and located between an upper end and a lower end of the carrier, the first coupler configured to receive the mitt, and a forwardly contoured region located below and projecting in front of the first coupler, the carrier configured to contact the mitt with the forwardly contoured region and hold the mitt spaced apart from the user's body with the opening of the mitt accessible for reception of the hand;

wherein the mitt includes a rigid member surrounding the opening and configured for passage of the hand therethrough; and wherein the mitt includes a resealable pouch surrounding the opening and the rigid member is removably located in the resealable pouch.

4. The mitt system according to claim 3, further including:

the mitt having a second coupler configured to couple with the first coupler of the carrier.

5. The mitt system according to claim 4, wherein:

the first coupler and the second coupler are magnetically connectable.

6. The mitt system according to claim 3, wherein:

the proximal face of the carrier includes a clip.

7. The mitt system according to claim 3, wherein:

the upper end of the carrier is configured for attachment to the user's body.

8. The mitt system according to claim 3, cooperating with an item which a user desires not to touch, the mitt system further including:

a strap located on the palm side of the external surface and configured to retain the item in contact with the external surface.

9. The mitt system according to claim 3, wherein:

the carrier includes a dispenser for sanitary products.

10. The mitt system according to claim 3, wherein:

the back side of the external surface has a pocket configured to be opened without manipulation of the palm side of the external surface.

11. The mitt system according to claim 3, wherein:

the rigid member has a second coupler configured to couple with the first coupler of the carrier.

12. A mitt configured for cooperation with a carrier wearable on a user's body, the carrier having a first coupler, the mitt comprising:

an opening, a thumb section, a finger section, and an external surface having a palm side and a back side;

a second coupler configured to couple with the first coupler of the carrier;

a resealable pouch surrounding the entire opening; and, a rigid member removably located in the resealable pouch, the rigid member configured for passage of the hand therethrough such that reception of the hand by the thumb section and the finger section is realized without manipulation of the external surface, the second coupler is located on the rigid member.

13. The mitt according to claim 12, further cooperating with an item which a user desires not to touch, the mitt including:

a strap located on the palm side of the external surface and configured to retain the item in contact with the external surface.

14. The mitt according to claim 12, wherein:

the back side of the external surface has a pocket configured to be opened without manipulation of the palm side of the external surface.

* * * * *